US007289753B2

(12) United States Patent
Inoue

(10) Patent No.: US 7,289,753 B2
(45) Date of Patent: Oct. 30, 2007

(54) IMAGE FORMING APPARATUS AND CHARGING UNIT THEREFOR

(75) Inventor: Ryo Inoue, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 11/001,020

(22) Filed: Dec. 2, 2004

(65) Prior Publication Data

US 2005/0135839 A1 Jun. 23, 2005

(30) Foreign Application Priority Data

Dec. 4, 2003 (JP) ..... 2003-405951

(51) Int. Cl.
*G03G 15/02* (2006.01)

(52) U.S. Cl. ..... 399/174; 399/175; 399/168

(58) Field of Classification Search ..... 399/174, 399/175, 168

See application file for complete search history.

(56) References Cited

U.S. PATENT DOCUMENTS

| | | | | |
|---|---|---|---|---|
| 5,367,365 | A * | 11/1994 | Haneda et al. | 399/174 |
| 5,659,852 | A * | 8/1997 | Chigono et al. | 399/175 |
| 6,219,514 | B1 * | 4/2001 | Kobayashi et al. | 399/277 |
| 6,792,232 | B2 | 9/2004 | Suzuki et al. | 399/175 |
| 2001/0043820 | A1 | 11/2001 | Kadota et al. | 399/175 |
| 2003/0228172 | A1 | 12/2003 | Nakamura et al. | 399/174 |

FOREIGN PATENT DOCUMENTS

| | | |
|---|---|---|
| CN | 1157941 | 8/1997 |
| JP | 6-3921 | 1/1994 |
| JP | 8-44153 | 2/1996 |
| JP | 9-325564 | 12/1997 |
| JP | 2001-290343 | 10/2001 |

OTHER PUBLICATIONS

Chinese Office Action and English translation in counterpart application No. 200410096910.0, dated Apr. 27, 2007.

* cited by examiner

*Primary Examiner*—Walter Benson
*Assistant Examiner*—Amy He
(74) *Attorney, Agent, or Firm*—Fitzpatrick, Cella, Harper & Scinto

(57) ABSTRACT

An image forming apparatus includes an image bearing member, and first and second chargers. Each of the chargers includes a magnetic member for generating magnetism, has a holding member for holding magnetic particles by a magnetic force, and charges the image bearing member by bringing the magnetic particles in contact therewith. The magnetic member of each of the chargers has a magnetic pole facing the image bearing member. The second charger is located at the tail end in the image bearing member rotational direction, but before a position at which an image is formed on the image bearing member. In the image bearing member rotation direction, and relative to a position at which the image bearing member comes closest to the holding member, the first charger's magnetic member has a peak magnetic force positioned downstream, and the second charger's magnetic member has a peak magnetic force positioned upstream.

10 Claims, 4 Drawing Sheets

IMAGE FORMING APPARATUS AND CHARGING UNIT THEREFOR

BACKGROUND OF THE INVENTION

1. Field of the Invention

The present invention relates to an image forming apparatus provided with a charging means which evenly charges an image bearing member using electroconductive, magnetic particles, suitably used for electrophotographic copiers and their printers, in particular.

2. Related Background Art (1) Charging Means

Charging means for even charging treatment (including elimination treatment) of an image bearing member, e.g., electrophotographic photosensitive member, electrostatic recording dielectric or the like, to secure a given potential of given polarity on the carrier surface in image forming apparatuses fall into two general categories, non-contact and contact types.

a) Non-contact Charging Means

A corona charging device (or discharging device) is a non-contact charging means facing an image bearing member (hereinafter referred to as photosensitive member) in a non-contact manner to expose the photosensitive member surface to a corona shower discharged when a high voltage is applied and thereby to charge the surface at a given potential of given polarity with a discharge-generated product.

b) Contact Charging Means

A contact charging means brings an electroconductive, charging members, e.g., roller (charging roller), fur brush, magnetic brush, blade or the like, to a photosensitive member, and applies a given charging bias to the photosensitive member surface to charge the surface at a given potential of given polarity. It has advantageous for the low ozone production and low power requirement, among others, over a corona charging device.

A charging bias may be applied to a contact charging means either by a DC bias method in which only a DC bias is applied and AC bias method in which a DC bias overlapped with an AC bias is applied.

A charging mechanism (charging mechanism or principle) for contact charging means is a mixture of corona charging and contact injection charging systems, and its characteristics are mainly determined by those of the predominant one.

A corona charging system produces a discharge phenomenon, e.g., corona discharge, in a fine gap between the contact charging means and photosensitive member, to charge the photosensitive member surface with a discharge-generated product. A corona charging system produces trace quantities of ozone, although to a much lower extent than a corona charging device.

A contact injection charging system directly injects charges from a contact charging member into a photosensitive member to charge the photosensitive member surface. This procedure is sometimes referred to as direct charging or injection charging. Japanese Patent Application Laid-Open No. 6-3921 proposes a method for contact injection charging in which charges are injected into a charge-holding member, e.g., trap level on a photosensitive member surface or electroconductive particles in a charge injecting layer, by contact charging member, e.g., charging roller, charging brush or charging magnetic brush.

An organic photosensitive member capable of charging by contact injection, for example, should be coated with a charge injecting layer dispersed with fine, electroconductive particles as a charge-holding member. On the other hand, an inorganic photosensitive member, beginning with that of amorphous silicon, needs no charge injecting layer anew, because it has a number of trap levels resulting from crystal defects on the surface, which can hold the injected charges for charge injection.

Contact injection charging is not based on a discharge phenomenon, and only needs a photosensitive member surface potential as charging voltage. Therefore, it is an ozone-less, low-power charging method. Moreover, it can theoretically increase a surface potential of the charged member to a voltage applied thereto, and makes the member resistant to changes in ambient conditions, e.g., moisture.

On the other hand, contact injection charging injects charges into a photosensitive member only through a surface area at which it is in contact with a charging member, by which is meant that its charging capacity is determined by ratio of contact between a charging member and photosensitive member. When there is a large uncharged area left at an insufficient contact ratio, charging may be terminated before surface potential on a photosensitive member reaches a voltage applied to a charging device.

The effective charging methods for securing a high contact ratio evenly over an entire area to be charged include bringing a magnetic brush composed of magnetically restricted, electroconductive, magnetic particles in contact with a photosensitive member, and bringing an elastic roller of electroconductive sponge or the like with fine, electroconductive particles deposited thereon in contact with a photosensitive member via the fine particles.

The former method generally brings magnetic particles in contact with a photosensitive member, where a charging bias is applied to an electroconductive, rotational sleeve containing a multipolar magnet roller, placed in the vicinity of the photosensitive member to hold the magnetic particles thereon by its magnetic force, with quantity of the particles being controlled and uniformized by a doctor blade as a magnetic particle restricting member.

The latter method brings fine, electroconductive, magnetic particles, deposited on an electroconductive, sponge roller with fine pores, in contact with a photosensitive member, where a charging bias is applied to the roller. The fine particles expand the electrical contact area between the roller and photosensitive member, and, at the same time, work to reduce friction between them and further increase contact probability between them, for which the sponge roller is driven to rotate based on difference in peripheral velocity between them.

c) Plural Magnetic Brush Charging Means

Charge injection in contact injection charging is based on a charging phenomenon in a condenser with an electroconductive board of a photosensitive member and contact area of a charging member as electrodes. Therefore, a certain extent of charging time is theoretically needed to secure a desired potential. Increasing process speed decreases time for charges to pass through a contact area, when it is set constant, leading to shortened charging time, with the result that a desired potential may not be secured. An inorganic photosensitive member, e.g., that of amorphous silicon, has a higher dielectric constant than an organic photosensitive member, and needs more charges and hence a longer charging time. A longer charging time is also needed, when a toner or additive for a toner cannot be removed by a cleaning device and is deposited on electroconductive, magnetic particles to increase their resistance.

Japanese Patent Application Laid-Open No. 8-44153 proposes an image forming apparatus provided with plural magnetic brush charging means, in order to solve these problems. This apparatus charges a photosensitive member by an upstream charging means located in the upstream of the photosensitive member rotation direction and additionally by a downstream charging means to secure a desired potential on the photosensitive member, because the upstream means alone cannot sufficiently secure the potential. In other words, it charges a photosensitive member 2 or more times to control charging-related problems, e.g., uneven contact or resistance of a charging member even at a high process speed, because of extended charging time. Moreover, a desired potential on the photosensitive member can be secured at a reduced charging load for an individual charging device, because potential fluctuations can be controlled even when the charging member has an increased resistance caused by its contamination or changed ambient conditions. As a result, this brings another advantage of easily expanding service life of the apparatus.

However, a structure with plural magnetic brush charging means involves the following problems.

The photosensitive member has an insufficient potential relative to voltage which the upstream magnetic brush charging means applies thereto while it is passing over the photosensitive member, with the result that contrast between the charging means and photosensitive member surface is expanded. This increases intensity of an electrical field produced by the charging means for the photosensitive member, to accelerate deposition of the magnetic particles on the photosensitive member. The magnetic particles left on the photosensitive member by the upstream magnetic brush charging means causes uneven potential between the surface portion on which the particles are deposited and particle-free portion while the downstream magnetic brush charging means is charging the photosensitive member. It is therefore necessary to control, as far as possible, deposition of the magnetic particles of the upstream magnetic brush charging means on the photosensitive member, for which the charging means should have a sufficient magnetic force to hold the particles.

On the other hand, the downstream magnetic brush charging means involves its own problems. Potential contrast between the photosensitive member and downstream means contracts while the latter is passing over the former, because of increased potential of the former. This prevents deposition of the magnetic particles on the photosensitive member. However, resistance may not be evenly distributed on the photosensitive member surface, when the magnetic brushes are not even in the gap between the photosensitive member and downstream means, to cause uneven potential distribution on the photosensitive member surface after the means leaves. It is therefore necessary to reduce uneven magnetic brushes in the gap between the downstream means and photosensitive member.

SUMMARY OF THE INVENTION

It is an object of the present invention to provide a charging apparatus which can prevent deposition of magnetic particles of an upstream charging means on a photosensitive member, and also prevent uneven potential distribution on the photosensitive member after the charging means leaves.

It is an object of the present invention to provide a charging device comprising: an image bearing member which supports an image, a first charging means which includes a magnetic member for generating magnetism, has a holding member for holding magnetic particles by a magnetic force, and charges the image bearing member by bringing the magnetic particles in contact with the image bearing member; the magnetic member of the first charging means having a magnetic pole facing the image bearing member, and also having a peak magnetic force position downstream, in the image bearing member rotation direction, relative to a position at which the image bearing member comes closest to the holding member, and a second charging means which includes a magnetic member for generating magnetism, has a holding member for holding magnetic particles by magnetic force, is located at the tail end in the image bearing member rotation direction but before a position at which an image is formed on the image bearing member, and charges the image bearing member, after charged by the first charging means, by bringing the magnetic particles in contact with the image bearing member; the magnetic member of the second charging means having a magnetic pole facing the image bearing member, and also having a peak magnetic force position upstream, in the image bearing member rotation direction, relative to a position at which the image bearing member comes closest to the holding means.

The other objects of the present invention will be clarified by description of this specification.

DESCRIPTION OF THE PREFERRED EMBODIMENTS

EXAMPLE 1

Figure 1:
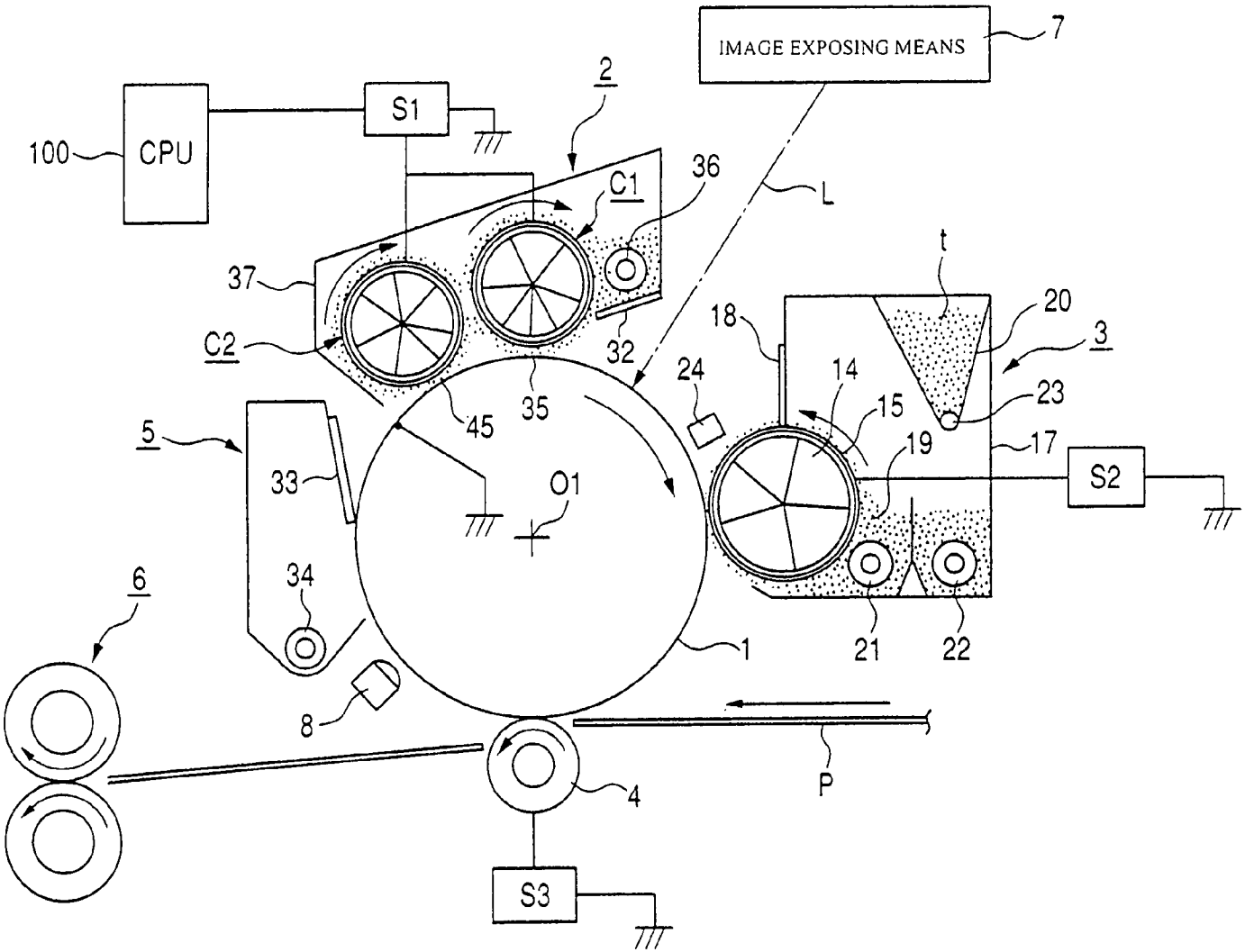
FIG. 1 schematically outlines a structure of the image forming apparatus for EXAMPLE 1.

FIG. 1 schematically outlines a structure of the image forming apparatus for EXAMPLE 1.

(1) Overall Structure of Image Forming Apparatus

The image forming apparatus of the present invention is a laser beam printer provided with plural magnetic brush charging means, working on a transfer electrophotogrpahic process.

In FIG. 1, the rotational drum type electrophotographic photosensitive member 1 (hereinafter referred to as the photosensitive drum 1) working as an image bearing member is driven to rotate clockwise in the arrowed direction at a given peripheral velocity. The photosensitive drum 1 for EXAMPLE 1 is made of amorphous silicon (a-Si).

The multiple magnetic brush charging unit 2 works as a charging device provided with plural magnetic brush charging means. It evenly charges the rotational photosensitive drum 1 surface at a given potential of given polarity (about −700V in EXAMPLE 1). The brush charging unit of EXAMPLE 1 is provided with plural magnetic brush charging means. However, it may be unitized with one magnetic brush charging means.

The image exposing means 7 is a laser beam scanner equipped with a laser diode, polygon mirror and the like in EXAMPLE 1. It emits laser beams L having a wavelength of 680 nm, intensity-modulated according to time-series electrical digital image signals for target image information, to scan the photosensitive drum 1 surface, evenly and precisely charged by the multiple magnetic brush charging unit 2 provided with-plural magnetic brush charging means. The photosensitive drum 1 surface has a potential decreased in the areas irradiated with the laser beams L, to form thereon an electrostatic latent image (electrostatic image) corresponding to target image information.

The developing means 3 develops an electrostatic latent image, formed on the photosensitive drum 1 surface, as a toner image in the development section. It is a reversal development device working with a two-component developer in EXAMPLE 1. A negatively charged toner is deposited on the exposed bright areas in the electrostatic image, i.e., the areas irradiated with the laser beams L on the photosensitive drum 1 surface, for reversal development of the latent image.

The transporting roller 4 works as a transporting means. It is composed of a core metal covered by an elastic layer of intermediate resistance, which are formed into a roller-shape monolithic structure. It is pressed to the photosensitive drum 1 surface at a given pressure to form a transporting nip section. The transporting roller 4 rotates in the same direction as the photosensitive drum 1 at the almost same peripheral velocity. A given transporting bias is applied at controlled time intervals to the core metal of the transporting roller 4 from the power source S3, where polarity of the bias (positive in EXAMPLE 1) is opposite to that of the toner.

The transporting medium P as a recording medium is supplied at controlled time intervals from a paper supply mechanism (not shown) to the transporting nip section, by which it is sent while being held between the photosensitive drum 1 and transporting roller 4. A given transporting bias is applied at controlled time intervals to the core metal of the transporting roller 4 from the power source S3 while the transporting medium P is passing through the transporting nip section to electrostatically transport the toner image from the photosensitive drum 1 surface to the transporting medium P, where polarity of the bias (positive in EXAMPLE 1) is opposite to that of the toner.

The transporting medium P leaving the transporting nip section is separated from the photosensitive drum 1 surface and sent to the fixing device 6, where an unfixed toner image is fixed under heat and pressure on the transporting medium P surface, and then discharged as the image-carrying medium (printed medium or copy).

The eliminating means 8 is composed of an LED which emits light of 660 nm as a central wavelength in EXAMPLE 1 onto the photosensitive drum 1 surface for exposure of the entire surface, after the transporting medium is separated therefrom, to erase the electrical memories from the surface by eliminating light irradiation (whole image exposure).

The cleaner 5, located downstream of the eliminating means 8, cleans the photosensitive drum 1 surface by removing deposits, e.g., residual toner, paper debris or the like, from the surface left by the transporting medium. The photosensitive drum 1, after being cleaned by the cleaner 5, is charged again by the multiple magnetic brush charging unit 2 and is provided with plural magnetic brush charging means for image forming repeatedly.

The cleaner 5 has the cleaning blade 33 as a cleaning means. It is made of a silicon-modified polyurethane rubber, and supported by a plate. The toner scraped off by the cleaning blade 33 from the photosensitive drum 1 surface is sent by the screw 34 to a spent toner container (not shown).

The potential sensor 24 can measure potential on the photosensitive drum 1 surface exposed to the laser beams. It is connected to the control circuit portion (central processing unit(CPU)) 100, which controls the charging and exposure steps in accordance with the measured potential on the photosensitive drum 1 surface.

(2) Photosensitive Drum 1

Figure 2:
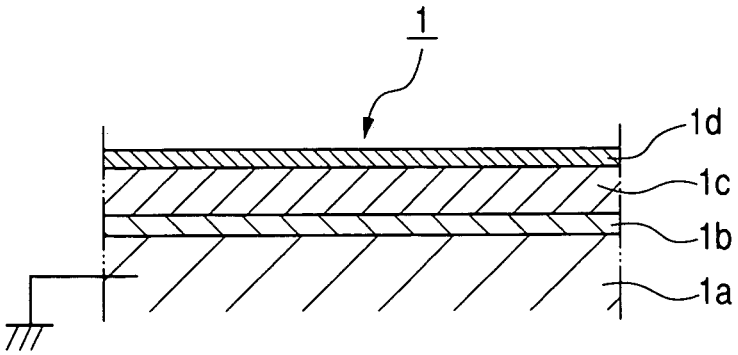
FIG. 2 schematically illustrates a layered photosensitive drum structure.

The photosensitive drum 1 as an image bearing member is made of amorphous silicon (a-Si) in EXAMPLE 1, and is driven to rotate clockwise in the arrowed direction at a given peripheral velocity of 200 mm/second. FIG. 2 schematically illustrates a layered structure of the a-Si photosensitive drum 1. It is composed of an Al cylinder (diameter: 60 mm) as the electroconductive supporter 1*a*, which is coated with a charge injection preventing layer 1*b*, photoconductive layer 1*c* and surface layer 1*d*, in this order. The charge injection preventing layer 1*b* works to block flow of charges from the electroconductive supporter 1*a* to the photoconductive layer 1*c*. The photoconductive layer 1*c* is made of an amorphous material mainly composed of silicon to exhibit photoconductivity. The surface layer 1*d* contains silicon and carbon, and works to keep the electrostatic latent image formed thereon and, at the same time, to improve durability of the film.

An inorganic photosensitive drum, e.g., that of a-Si, needs no charge injecting layer anew for charge injection, because it has a number of trap levels resulting from crystal defects on the surface, which can hold the injected charges for charge injection.

The a-Si photosensitive drum 1 involves a problem coming from its characteristics that, when the light-irradiated region and dark region are simultaneously charged, potential on the light-irradiated region is attenuated much greater (attenuation of the dark region) than that on the dark region, which tends to cause photomemories (residual image phenomenon).

In other words, an a-Si photosensitive drum contains a number of dangling bonds working as local levels which partly capture the photocarriers to reduce their movability or recombination probability of the light-generating carriers. In the image forming process, therefore, part of the photocarriers generated in the exposure step are released from the local levels in the subsequent charging step as soon as the a-Si photosensitive drum 1 is placed in an electrical field, to produce a surface potential difference between the exposed and unexposed portions, which eventually results in photomemory-caused unevenness of the image.

Therefore, it is a common procedure to perform even exposure in the elimination step by the eliminating means 8 for excessively keeping the latent photocarriers in the a-Si photosensitive drum and evenly distributing them over the entire surface to erase the photomemories. The photomemories can be effectively erased by increasing quantity of light emitted from an elimination light source, or bringing elimination light wavelength close to a spectral sensitivity peak (around 600 to 700 nm) of the a-Si photosensitive drum. The eliminating means 8 in EXAMPLE 1 is equipped with an LED which emits light of 660 nm as a central wavelength.

On the other hand, potential on the photosensitive drum 1 is attenuated over the entire surface, when it is irradiated with eliminating light, with the result that potential on the photosensitive drum 1 is different from that measured by the potential sensor 24 at a position, e.g., at which the toner is developed by the developing device 3. This potential attenuation should be taken into consideration when the conditions under which a voltage is applied to the developing device are set.

(3) Developing Device 3

The developing device 3 in EXAMPLE 1 is equipped with a rotating sleeve 15 containing the stationary magnet roll 14, which sends the developer 19 held in the developing container 17 by the blade 18, the developer 19 running in a thin film over the sleeve 15. The sleeve 15 is driven by a motor (not shown) to rotate in the arrowed direction at a peripheral velocity of 300 mm/second.

The developer 19 is of a two-component type, composed of a negatively chargeable toner of 8 μm in size and positively chargeable, magnetic carrier of 50 μm in size are mixed at a toner concentration of 5% by weight. The toner t held in the toner hopper 20 is supplied by the supply roller 23, while its concentration is controlled by an optical toner concentration sensor (not shown). The developer 19 is evenly stirred by the stirring members 21 and 22 in the container.

A developing bias of an AC field of 2 kVpp and 2 kHz overlapped with a DC voltage of Vde of −500 V is applied to the sleeve 15 from the power source S2. The developer sent to the developing section after running in a thin film in the AC+DC filed contributes to development of the latent image on the photosensitive drum 1.

(4) Multiple Magnetic Brush Charging Unit 2

Figure 3:
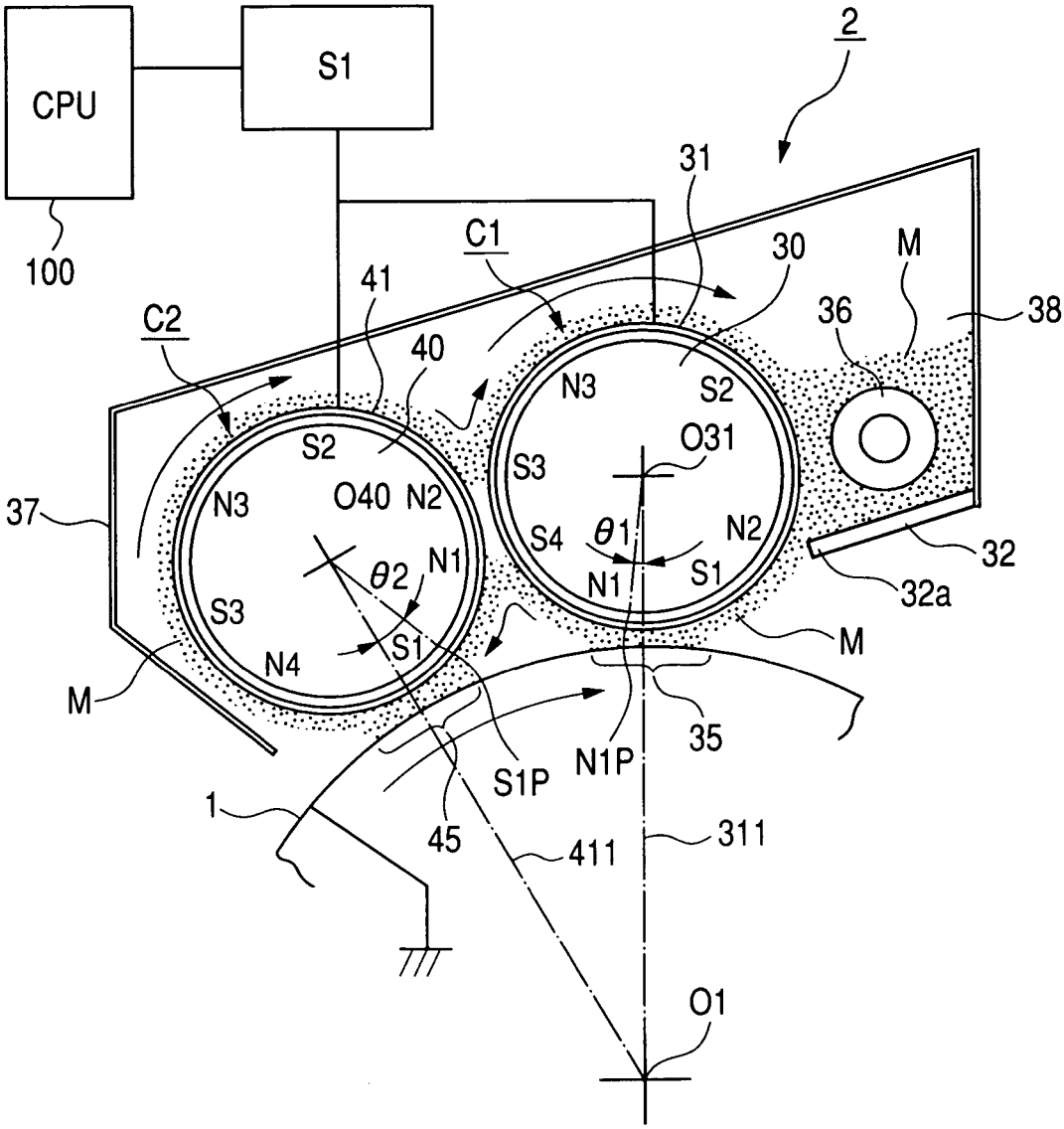
FIG. 3 shows a magnified model of a charging means (magnetic brush charging unit provided with plural magnetic brush charging means)

FIG. 3 is a partly magnified view which schematically illustrates the multiple magnetic brush charging unit 2. The unit 2 of EXAMPLE 1 has two magnetic brush charging devices C1 and C2 located adjacent to each other as magnetic brush charging means contained in the unit housing 37, the latter working as the first device for transporting the electroconductive, magnetic particles M and the former as the second device also for transporting the particles M, located downstream of the device C2 in the rotation direction of the photosensitive drum. The blade 32 is a conductive magnetic particle control blade for controlling quantity of the particles M moving on the device C1, fixed in the unit housing 37 downstream of the device C1 in the rotation direction of the photosensitive drum and having the edge 32*a* facing the rotational sleeve 31 (later described) of the device C1 with a given gap in-between; the space 38 for holding the particles M, located in the unit housing 37 downstream of the device C1 in the rotation direction of the photosensitive drum and over the blade 32; stirring screw 36 located in the space 38 for stirring the particles M, where the particles M are transported from the space 38 onto the outer peripheries of the rotational sleeves 31 and 41 (later described) of the devices C1 and C2, by which they are supported to work as the magnetic brushes.

The devices C1 and C2 have the respective sleeves 31 and 41 (diameter: 20 mm each) as the rotatable, electroconductive members, and which contain the stationary magnet rollers 30 and 40 as the magnetic field generating means in the sleeves 31 and 41, where the sleeve 31 or 41 is set 0.5 mm apart from the photosensitive drum 1, and sleeves 31 and 41 are set also 0.5 mm apart from each other. Both the sleeves 31 and 41 are driven to rotate clockwise at a peripheral velocity of 200 mm/second in the arrowed direction. The screw 36 is also driven to rotate to stir the particles M held in the space 38 in the sleeve 31's bus line direction. The screw 36, provided with elliptic blades at alternate positions, can evenly stir the particles in the space 38.

Part of the particles M in the space 38 are magnetically restricted by the magnet roller 30 on the outer surface of the sleeve 31 in the device C1 to work as the magnetic brushes, and transported by rotation of the sleeve 31 to pass through the gap between the sleeve 31 and blade 32, where thickness of the magnetic brush layer is controlled to a given level, and then carried through the gap between the sleeve 31 and photosensitive drum 1 to come into contact with the drum 1 surface in the region 35 while sliding on the drum 1 surface. The region 35, where the magnetic brushes come into contact with the drum 1 surface while sliding thereon, is the region in which the drum 1 surface is charged by the device C1.

The magnetic brushes of the particles M, after passing through the gap between the sleeve 31 and photosensitive drum 1, are transported to an area closest to the sleeves 31 and 41 of the respective devices C1 and C2, and then towards the sleeve 41 side of the device C2. In the above area, the magnetic brushes of the particles M are magnetically transported from the sleeve 31 side of the device C1 to the sleeve 41 side of the device C2 by the actions of the magnetic field, generated by the opposite magnetic poles of S4/S3 and N1/N2 located in the devices C1 and C2 in such a way to face each other.

The magnetic brushes of the particles M, after being transported to the sleeve 41 side of the device C2, are magnetically restricted by the magnet roller 40 on the outer surface of the sleeve 41 to the gap between the sleeve 41 and the photosensitive drum 1 to work as the magnetic brushes, and transported by rotation of the sleeve 41 to pass through the gap between the sleeve 41 and photosensitive drum 1 to come into contact with the drum 1 surface in the region 45 while sliding on the drum 1 surface. The region 45, where the magnetic brushes come into contact with the drum 1 surface while sliding thereon, is the region in which the drum 1 surface is charged by the device C2.

The magnetic brushes of the particles M, after passing through the gap between the sleeve 41 and photosensitive drum 1, are transported by rotation of the sleeve 41 back to the area closest to the sleeves 31 and 41 of the respective devices C1 and C2, where the magnetic brushes of the particles M are magnetically transported again from the sleeve 41 side of the device C2 to the sleeve 31 side of the device C1 by the actions of the magnetic field, generated by the opposite magnetic poles of S4/S3 and N1/N2.

The magnetic brushes of the particles M, after being transported back to the sleeve 31 side of the device C2, are magnetically restricted by the magnet roller 30 on the outer surface of the sleeve 31 to work as the magnetic brushes, and transported by rotation of the sleeve 31 back to the space 38 for holding the particles M.

As described above, the particles M are transported from the space 38 to the sleeve 41 of the device C2 while being held by the sleeve 31 of the device C1, and back to sleeve 31 of the device C1, to be recycled back to the space 38.

A charging bias of an AC field of 200 Vpp and 1 kHz overlapped with a DC voltage of Vde of −700 V can be applied to the sleeves 31 and 41 of the respective devices C1 and C2 from the power source S1. The power source S1 is connected to the control circuit portion (central processing unit (CPU)) 100, which can switch application of voltage on or off and control DC voltage level.

Contact injection charging is performed on the rotating photosensitive drum 1 by the rotating sleeves 31 and 41 of the respective magnetic brush charging devices C1 and C2 when the above-described bias voltage is applied to the sleeves 31 and 41 from the power source S1, first by the device C2 upstream in the drum rotation direction in the charging region 45 and then by the downstream sleeve C1 in the charging region 35, to finally secure a given charging potential of −700 V evenly over the drum 1 surface.

The potential is controlled in accordance with the surface potential of the photosensitive drum 1, measured by the potential sensor 24, at an optimum value together with extent of exposure or the like for changed ambient conditions and temporal changes.

When the charging sleeves 31 and 41 rotate at an excessively low peripheral velocity, the photosensitive drum surface and electroconductive, magnetic particles are in contact with each other at an insufficient contact probability, to cause defective images resulting from troubles, e.g., uneven charging. When they rotate at an excessively high peripheral velocity, on the other hand, the magnetic particles may be scattered excessively. The preferable peripheral velocity of the charging sleeves for satisfactory charging is in a range from 50 to 250 mm/second in EXAMPLE 1, although varying depending on sleeve outer diameter and distance between the sleeve and photosensitive drum.

The following particles are suitably used as the electroconductive, magnetic particles for the present invention.

- Particles of a resin and magnetic material, e.g., magnetite, kneaded and formed into particles, and these particles incorporated with an electroconductive material, e.g., carbon, to adjust their resistance
- Particles of sintered magnetite or ferrite, and these particles treated by reduction or oxidation to adjust their resistance
- The above electroconductive, magnetic particles coated with a coating material (e.g., phenol resin dispersed with carbon) of adjusted resistance, or plated with a metal, e.g., Ni, to adjust their resistance When these particles have an excessively high resistance, charges may not be evenly injected into the photosensitive drum 1 to cause fogged images resulting from slightly unsatisfactory charging. When they have an excessively low resistance, on the other hand, pin hole leak may occur to cause an overload of the power source and hence voltage drop resulting from current flowing through the pin holes to prevent satisfactory charging of the photosensitive drum surface at the charging nip. These particles, therefore, preferably have a resistance of $1\times10^4$ to $1\times10^7$ Ω. Of the magnetic characteristics, saturation magnetization is preferably 50 $A\cdot m^2/kg$ or more to keep high magnetic restriction force and thereby to prevent deposition of the magnetic particles on the photosensitive drum.

The resistance of the magnetic particles is measured with a metallic cell whose base area is 227 $mm^2$ and into which the magnetic particles of 2.0 g are added and the weight of 6.6 $kg/cm^2$ applied, in the condition that 500 V is applied to the metallic cell.

The magnetic particles actually used in EXAMPLE 1 had a volume-average particle diameter of 30 μm, apparent density of 2.0 $g/cm^3$, resistance of $1\times10^6$ Ω and saturation magnetism of 58 $A\cdot m^2/kg$.

Diameter of the electroconductive, magnetic particles affects charging capacity and charging evenness. When it is excessively large, contact ratio of the particles with the photosensitive drum decreases to cause uneven charging. When it is excessively small, on the other hand, magnetic force acting on each particle decreases to accelerate deposition of the particles on the photosensitive drum, although both charging capacity and charging evenness are improved. Therefore, the electroconductive, magnetic particles having a diameter of 5 to 100 μm are suitably used for the present invention.

In the magnet roller 30 as a magnetic field generating means in the sleeve 31 as a rotational, electroconductive member of the magnetic brush charging device C1, the magnetic pole N1 facing the photosensitive drum 1 as an image bearing member tilts at an angle of θ1, at the peak position N1P, to the line 311 connecting the rotational center 031 of the sleeve 31 and the rotational center 01 of the photosensitive drum 1. Similarly, in the magnet roller 40 as a magnetic field generating means in the sleeve 41 as a rotational, electroconductive member of the magnetic brush charging device C2, the magnetic pole S1 facing the photosensitive drum 1 tilts at an angle of θ2, at the peak position S1P, to the line 411 connecting the rotational center 040 of the sleeve 41 and the rotational center 01 of the photosensitive drum 1. In the magnetic brush charging unit 2 of EXAMPLE 1, provided with plural magnetic brush charging means, these angles θ1 and θ2 are set at +5° and −30°, where the sign "+" means the angle in the forward direction with respect to the rotation direction of the sleeve 31 or 41, whereas the sign "−" means the angle in the opposite direction. The line connecting the rotational centers crosses the point at which each sleeve is drawn when each sleeve comes closest to the photosensitive drum 1.

Next, the effects of angles θ1 and θ2 on deposition of the electroconductive particles and output image coarseness are discussed.

1) IN THE CASE OF COMPARATIVE EXAMPLE

Figure 4:
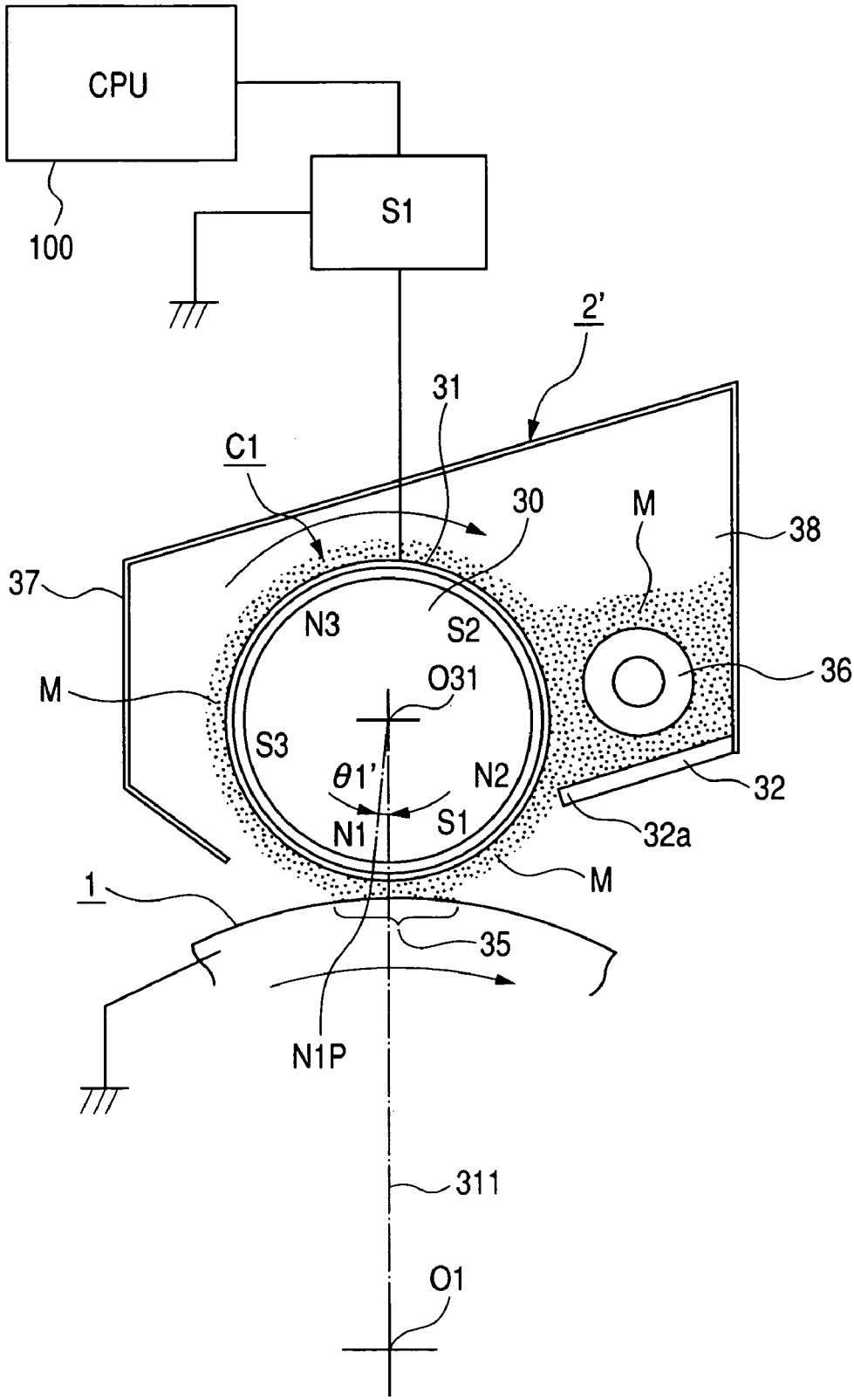
FIG. 4 shows a model of magnetic brush charging unit of COMPARATIVE EXAMPLE.

First, consider that the photosensitive drum 1 is charged not by the multiple magnetic brush charging unit 2 of EXAMPLE 1 but by the magnetic brush charging unit 2' provided with the magnetic brush charging device C1 alone (see FIG. 4).

The magnetic brush charging unit 2' shares the common structure with the multiple magnetic brush charging unit 2, except that the magnetic brush charging device C2 is removed to leave the device C1 alone and S4 as one of the magnetic poles in the magnet roller 30 is removed.

The magnetic brush charging unit 2' of the above structure is proposed by Japanese Patent Application Laid-Open No. 2001-290343, where the peak magnetic force of the magnetic pole facing the photosensitive drum is located downstream of the drum rotation direction to restrict the magnetic brushes by the magnetic force and thereby to prevent deposition of the magnetic particles caused by the magnetic field generated between the magnetic brush charging device and photosensitive drum. In this arrangement, however, the magnetic brushes stand notably in the charging region downstream of the drum rotation direction, to cause uneven contact of the electroconductive, magnetic particles with the photosensitive drum.

Uneven contact of the magnetic particles with the photosensitive drum in the final charging stage may cause fine unevenness of potential, extent of which depends on the contact conditions, resulting in coarse images with fine unevenness of concentration.

Table 1 shows the effects of angle θ1' on deposition of the electroconductive particles and output image coarseness, where θ1' represents an angle at which the magnetic pole N1 facing the photosensitive drum 1 tilts to the line 311 connecting the rotational center O31 of the sleeve 31 and the rotational center O1 of the photosensitive drum 1, the pole N1 being in the magnet roller 30 as a magnetic field generating means in the sleeve 31. Deposition of the electroconductive, magnetic particles was evaluated after 100,000 copies were produced. The results are given in Table 1. In Table 1, "deposition of the electroconductive, magnetic particles" was evaluated according to the following standards after the photosensitive drum surface was observed by an optical microscope:

○: Probability of the presence of the particles: below 1/cm$^2$ x: Probability of the presence of the particles: 1/cm$^2$ or more "Output image coarseness" was evaluated according to the following standards after an A-4 size copy printed, over the entire surface, with half-tone images having a reflection concentration of 0.3 A was visually observed:

○: Coarseness not observed

<: Coarseness slightly observed x: Coarseness clearly observed

TABLE 1

| θ1' | Deposition of the electroconductive, magnetic particles | Output image coarseness |
|---|---|---|
| +15° | X | ○ |
| +10° | X | ○ |
| +5° | X | ○ |
| 0° | X | < |
| −5° | ○ | X |
| −10° | ○ | X |
| −15° | ○ | X |
| −20° | ○ | X |
| −25° | ○ | X |
| −30° | ○ | X |

As shown in Table 1, deposition of the electroconductive, magnetic particles was observed at θ1' of −0 to +15°, but not at −30 to −5°. These results conceivably indicate that, when the peak magnetic force of the pole facing the photosensitive drum is located downstream of the drum rotation direction, the magnetic force to attract the particles towards the transportation means is increased in the charging region downstream of the rotation direction to prevent movement of the particles towards the drum.

On the other hand, output image coarseness was no observed at θ1' of +5 to +15°, but observed at −30 to −5°. These results conceivably indicate that the magnetic force to attract the particles towards the transportation means is increased in the charging region downstream of the rotation direction, and, at the same time, the magnetic brushes stand notably in that region to cause uneven contact of the particles with the photosensitive drum and hence fine unevenness of potential corresponding to the particle conditions.

As discussed above, in COMPARATIVE EXAMPLE, the peak magnetic force position should be brought closer to the position facing the photosensitive drum in order to improve image quality by solving output image coarseness, which, however, may cause deposition of the electroconductive particles.

2) IN THE CASE OF EXAMPLE 1

The image forming apparatus provided with magnetic brush charging devices C1 and C2 of EXAMPLE 1 can solve uneven potential distribution which can cause image coarseness by evenly charging the photosensitive drum using the charging device C1 located downstream of the drum rotation direction, because potential difference which can cause image coarseness is limited.

Tables 2 and 3 give the effects of angles θ1 and θ2 in the multiple magnetic brush charging unit 2 of EXAMPLE 1, provided with plural magnetic brush charging means, on deposition of the electroconductive particles and output image coarseness.

TABLE 2

| θ2 | Deposition of the electroconductive, magnetic particles | Concentration unevenness | Output image coarseness |
|---|---|---|---|
| +15° | ○ | X | ○ |
| +10° | ○ | X | ○ |
| +5° | ○ | X | ○ |
| 0° | ○ | X | ○ |
| −5° | ○ | ○ | ○ |
| −10° | ○ | ○ | ○ |
| −15° | ○ | ○ | ○ |
| −20° | ○ | ○ | ○ |
| −25° | ○ | ○ | ○ |
| −30° | ○ | ○ | ○ |

θ1 = +5°

TABLE 3

| θ1 | Deposition of the electroconductive, magnetic particles | Concentration unevenness | Output image coarseness |
|---|---|---|---|
| +15° | ○ | ○ | ○ |
| +10° | ○ | ○ | ○ |
| +5° | ○ | ○ | ○ |
| 0° | ○ | ○ | < |
| −5° | ○ | ○ | X |
| −10° | ○ | ○ | X |
| −15° | ○ | ○ | X |
| −20° | ○ | ○ | X |
| −25° | ○ | ○ | X |
| −30° | ○ | ○ | X |

θ2 = −30°

Patterns of electroconductive particle deposition in the multiple magnetic brush charging unit 2 fall into two types, and deposition pattern in the magnetic brush charging device C1 is different from that in the device C2.

The electroconductive particles deposited in the first magnetic brush charging device C1 can be observed on the photosensitive drum surface. On the other hand, those deposited in the device C2 cannot be observed on the drum surface, because they are magnetically recovered by the device C1 as the downstream device. However, charging potential on the photosensitive drum 1 surface region on which the particles are deposited is reduced, because of decreased number of the particles capable of contributing to charging of the drum. This can cause uneven potential, distribution which is relatively notable in many cases, and result in production of images of uneven concentration, when an even potential distribution cannot be secured on the charged drum surface by the device C1.

In EXAMPLE 1, deposition of the electroconductive particles in the magnetic brush charging device C2 was judged by visually confirming uneven concentration on an A-4 size copy printed with half-tone images having a reflection concentration of 0.3A. It was evaluated according to the following standards:

○: Uneven concentration not observed x: Uneven concentration observed

Table 2 gives the results with θ1 set constant at +5° and θ2 changed in a range from −30 to +15°. As shown in Table 2, uneven concentration resulting from deposition of the electroconductive particles from the magnetic brush charging device C2 was observed in an angle range from 0 to +15°. However, no image coarseness, deposition of the electroconductive particles or uneven concentration was observed at an angle beyond the above range. These results indicate that the magnetic brush charging device C2 has an increased magnetic force in the charging region downstream in the rotation direction of the photosensitive drum at a θ2 of 5 to 30° to efficiently control deposition of the electroconductive particles, and that uneven potential distribution, which can result from uneven contact of the magnetic brushes notably standing as a result of the increased magnetic force to cause image coarseness, is solved by the magnetic brush charging device C1.

Table 3 gives the results with θ2 set constant at −30° and θ1 changed in a range from −30 to +15°. As shown in Table 3, uneven concentration resulting from deposition of the electroconductive particles from the magnetic brush charging device C2 was not observed. No deposition of the electroconductive particles was observed at a θ1 of −30 to +15° while the photosensitive drum is charged by the magnetic brush charging device C2, because it was already charged by the upstream charging device to reduce potential distribution. However, output image coarseness was observed as in COMPARATIVE EXAMPLE, because the coarseness reflects contact conditions of the electroconductive, magnetic particles when charging of the drum is completed. It is therefore preferable to set a θ1 at +5 to +15° for the magnetic brush charging device C1 provided as the tail charging device.

It was also observed in EXAMPLE 1 that the electroconductive, magnetic particles could not be transported to the charging region at a θ1 or 2 of +15° or more and −30° or less, to prevent normal charging.

It is concluded, based on the above findings, that even an inorganic photosensitive drum of high dielectric constant can be evenly charged without causing problems, e.g., output image coarseness, uneven concentration and deposition of electroconductive, magnetic particles even at a high process speed to stably produce high-quality images for extended periods by setting the peak magnetic force position N1P of the magnetic pole N1, located in the magnetic brush charging device C1 as the tail charging device to face the photosensitive drum 1, upstream of the drum 1 rotation direction, preferably at an angle of +5 to +15°, before the exposure means which forms an image on the drum 1 as it rotates, and, at the same time, by setting the peak magnetic force position S1P of the magnetic pole S1, located in the magnetic brush charging device C2 upstream of the device C1 with respect to the drum 1 rotation direction to face the drum 1, downstream of the drum rotation direction, preferably at an angle of −5 to −30°.

EXAMPLE 2

In EXAMPLE 2 an organic photosensitive member is used as the photosensitive drum 1. The other characteristics are similar to those of the device of EXAMPLE 1, and detailed description thereof is omitted.

Figure 5:
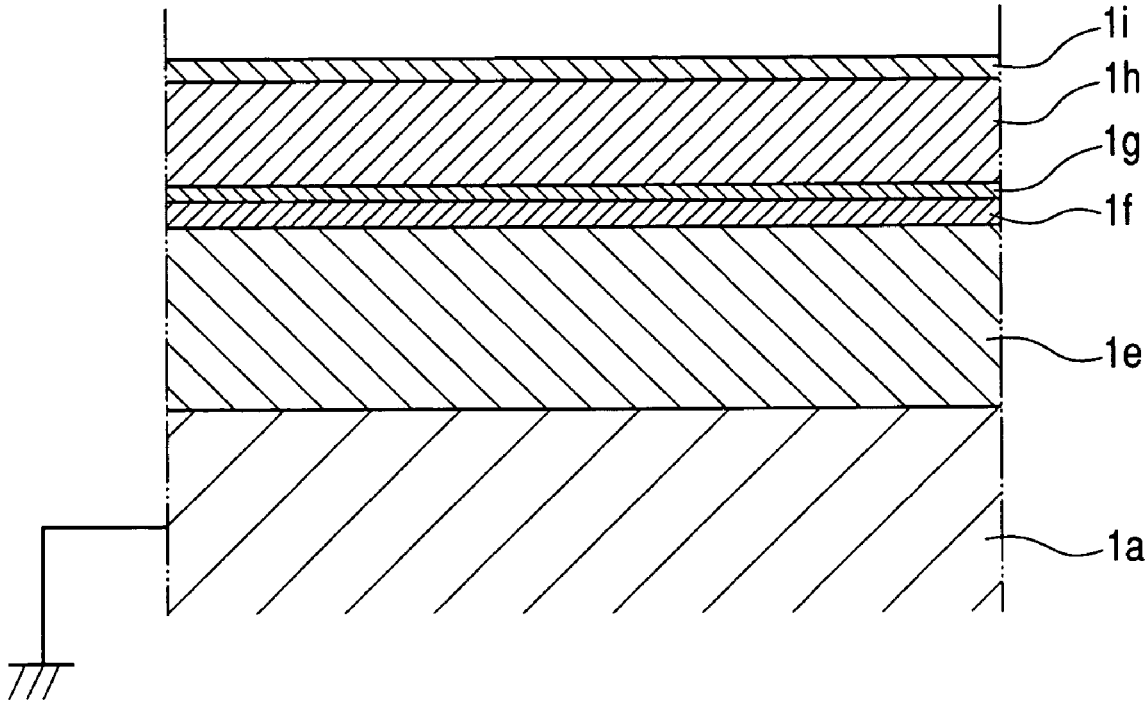
FIG. 5 schematically illustrates the layered photosensitive drum structure for EXAMPLE 2.

The photosensitive drum 1 for EXAMPLE 2 as an image bearing member is made of a negatively chargeable, OPC photosensitive member. It is of a layered structure with a grounded aluminum drum base 1*a*. (diameter: 30 mm) coated with the first to fifth functional layers 1*e* to 1*i*, in this order, as illustrated in FIG. 5.

The first layer 1*e* supported by the drum base 1*a* is an undercoat layer having a thickness of around 20 μm, provided to smoothen the defects or the like on the base 1*a* and to prevent moirés resulting from reflection of the laser beams for exposure.

The second layer 1*f* is a positive charge injecting layer working to prevent the positive charges injected from the aluminum drum base 1*a* from canceling out the negative charges on the photosensitive member surface. It is an around 1 μm thick layer of intermediate resistance, adjusted to have a resistance of around $10^6$ Ωcm with an Amiran resin and methoxylated nylon.

The third layer 1*g* is an around 0.3 μm thick, charge generating layer of resin dispersed with a disazo-based pigment. It generates positive and negative charge pairs, when exposed to laser beams.

The fourth layer 1*h* is a charge transporting layer. It is a P type semiconductor of a polycarbonate resin dispersed with hydrazone. Therefore, it can transport only the positive charges generated in the charge generating layer 1*g* to the surface of the photosensitive member while it cannot transport the negative charges on the surface of the photosensitive member.

The fifth layer 1*i* is a charge injecting layer provided on the surface of photosensitive member, which is a coated layer of a photo-curable acrylic resin dispersed with superfine $SnO_2$ particles. More specifically, the coated layer is of a material consisting of an acrylic resin, which is dispersed with $SnO_2$ particles of around 0.03 μm in diameter at 70% by weight on the resin after the particles are doped with antimony to have a reduced resistance. The coating solution thus prepared is coated by dipping to form a resulting charge injecting layer with a thickness of around 2 μm. This layer has a reduced volumetric resistance of the surface portion of the photosensitive member of $1\times10^{12}$ Ωcm compared with the case of only a charge transporting layer being provided indicating a resistance of $1\times10^{15}$ Ωcm. The charge injecting layer if preferably has a volumetric resistance of $1\times10^{9}$ Ωcm to $1\times10^{15}$ Ωcm, determined by a resistance meter (YHP, HIGH RESISTANCE METER 4329A) connected to a RESISTIVITY CELL 16008A for a sheet sample to which a voltage of 100 V was applied. For the measurement, an electroconductive sheet was coated with a bar-coded sample to a thickness of 10 μm. Resistance of the sample was estimated in consideration of resistance of the electroconductive sheet.

It is found, also in EXAMPLE 2, that the photosensitive drum 1 can be evenly charged without causing problems, e.g., output image coarseness, uneven concentration and deposition of electroconductive, magnetic particles thereby stably producing high-quality images for extended periods when the peak magnetic force position N1P of the magnetic pole N1, located in the magnetic brush charging device C1 to face the drum 1, is set to be upstream of the drum 1 rotation direction, preferably at an angle (θ1) of 0 to +15°, and, at the same time, by setting the peak magnetic force position S1P of the magnetic pole S1, located in the magnetic brush charging device C2, is set to be downstream of the drum rotation direction, preferably at an angle (θ2) of −5 to −30°.

Other Notes

1) The multiple magnetic brush charging unit 2 as a means for charging an image bearing member is provided with two magnetic brush charging devices (first and second ones) in each of EXAMPLES 1 and 2. However, it may be provided with 3 or more charging devices.

2) The image bearing member 1 is not limited to a rotational drum type used in each of EXAMPLES 1 and 2, and may be of endless belt, running web or transportable cut-sheet type.

3) The image exposure means as a means for writing information to the surface of the charged photosensitive member as an image bearing member for an image forming apparatus is not limited to laser beam scanning used in each of EXAMPLES 1 and 2, and may be a digital exposure means, e.g., that includes an array of solid-state emission elements, e.g., LEDs, or an analogue image exposure means with a halogen lamp, fluorescent light or the like as a manuscript lighting means. In short, any device can be used so long as it can form a latent image corresponding to image information.

4) The image bearing member for the present invention may be of an electrostatically recording dielectric or the like. When such a dielectric is used the surface thereof is primarily charged evenly at a given potential of given polarity, and then treated for selective elimination of charges by an adequate elimination means, e.g., elimination needle head or electronic gun, before an electrostatic latent image for image information is formed thereon.

5) A toner image formed on an electrophotographic photosensitive member or electrostatic recording dielectric as an image bearing member may be transferred onto an intermediate medium, and then onto a final recording medium, where it is fixed as a permanent image under heat, pressure or the like.

6) Also within the scope of image forming apparatus of the present invention is an image display device in which an electrophotographic photosensitive member or electrostatic recording dielectric as an image bearing member may be of a rotational belt type, on which a toner image corresponding to image information is formed by means for the charging, latent image formation and development steps, displayed after setting the portion on which the toner image is formed at a reading/display section, and then removed from the image bearing member without being transferred onto a medium, for repeated use for forming images to be displayed.

The charging unit of the present invention is structured to be detachable from an image forming apparatus body, where a first and second magnetic brush means for the unit can be detached as an assembly. However, it may be of a drum cartridge structure with a photosensitive drum, and first and second magnetic brush means being detached as an assembly. It is needless to say that it may be structured to allow each magnetic brush means to be detached separately.

As discussed above, the charging device of the present invention, provided with a plurality of charging means with magnetic particles, can improve stability of potential over a photosensitive member having left the charging device by preventing deposition of the magnetic particles from the upstream charging means on the photosensitive member and also preventing uneven magnetic brushes in the deposition of the magnetic particles from the upstream charging means on the photosensitive member and also preventing uneven magnetic brushes in the gap between the downstream charging means and photosensitive member.

It is to be understood that EXAMPLES described above by no means limit the present invention, and a number of variations may be made within the technical concept of the present invention.

This application claims priority from Japanese Patent Application No. 2003-405951 filed Dec. 4, 2003, which is hereby incorporated by reference herein.

What is claimed is:

1. A charging device comprising:

an image bearing member, which has a surface to bear an image and moves;

charging means, which includes a first charging member, which charges the surface of said image bearing member; and a second charging member provided at a downstream side of said first charging member in a moving direction of the surface of said image bearing member, wherein the second charging member recharges the surface of said image bearing member;

magnetic particles provided on the first and second charging members to contact said image bearing member, the first charging member charging the surface of said image bearing member and the second charging member recharging the surface of said image bearing member via said magnetic particles;

magnetic members provided in the first and second charging members to hold said magnetic particles;

a first magnetic pole provided in the first charging member, spaced from a first closest portion having a smallest distance between said first charging member and said image bearing member; and a second magnetic pole provided in the second charging member, spaced from a second closest portion having a smallest distance between said second charging member and said image bearing member;

wherein said first magnetic pole provided in the first charging member is at the downstream side of the first closest portion in the moving direction of the surface of said image bearing member, and wherein said second magnetic pole provided in the second charging member is at an upstream side of the second closest portion in the moving direction of the surface of said image bearing member.

2. A charging device according to claim 1, wherein said first charging means includes a first holding member which contains said magnetic members to hold magnetic particles on a surface by a magnetic force of said magnetic members and a second holding member which contains said magnetic member to hold magnetic particles on a surface by a magnetic force of said magnetic members.

3. A charging device according to claim 2, wherein the first and second holding members rotate in the same direction in which the image bearing member rotates.

4. A charging device according to claim 2, wherein the first and second charging members are located adjacent to each other, said first and second magnetic poles in the first charging member and that in the second charging member facing each other have different polarity, and the magnetic particles move on the first and second holding members.

5. A charging device according to claim 4, wherein magnetic particles are electroconductive.

6. A charging device according to claim 2, wherein said first and second holding members are rotatable.

7. A charging device according to claim 1, wherein the first charging member is provided at a portion at which the first charging member charges at an uppermost stream portion in a moving direction of the surface of said image bearing member after a toner image is transferred onto a recording material.

8. A charging device according to claim 1, wherein the magnetic member provided on the first charging member has a cylindrical shape and wherein the first magnetic pole provided on the first charging member is located within a range of an angle of 5 to 30 degrees at a downstream side of the first closest portion in the moving direction in which the surface of said image bearing member moves.

9. A charging device according to claim 1, wherein the magnetic member provided on the second charging member has a cylindrical shape, and wherein the second magnetic pole provided on the second charging member is located within a range of 0 to 15 degrees at an upstream side of the second closest portion in the moving direction of the surface of the image bearing member.

10. A charging device according to claim 1, wherein said charging device is detachably attached onto said image forming apparatus.

* * * * *